US010707620B2

(12) United States Patent
Imai et al.

(10) Patent No.: US 10,707,620 B2
(45) Date of Patent: Jul. 7, 2020

(54) CONNECTOR

(71) Applicant: Sumitomo Wiring Systems, Ltd., Yokkaichi, Mie (JP)

(72) Inventors: Yasuo Imai, Mie (JP); Yukihiro Fukatsu, Mie (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 16/253,249

(22) Filed: Jan. 22, 2019

(65) Prior Publication Data

US 2019/0229467 A1 Jul. 25, 2019

(30) Foreign Application Priority Data

Jan. 19, 2018 (JP) ..... 2018-007063

(51) Int. Cl.

| | |
|---|---|
| ***H01R 13/627*** | (2006.01) |
| ***H01R 13/639*** | (2006.01) |
| ***H01R 13/52*** | (2006.01) |
| ***H01R 13/422*** | (2006.01) |
| ***H01R 13/641*** | (2006.01) |

(52) U.S. Cl.

CPC ..... *H01R 13/639* (2013.01); *H01R 13/4223* (2013.01); *H01R 13/5202* (2013.01); *H01R 13/641* (2013.01); *H01R 13/6272* (2013.01)

(58) Field of Classification Search

CPC ..... H01R 13/6272; H01R 13/6275; H01R 13/4223; H01R 13/4362

USPC ..... 439/352, 358, 595, 752

See application file for complete search history.

(56) References Cited

U.S. PATENT DOCUMENTS

| | | | | |
|---|---|---|---|---|
| 5,230,636 | A * | 7/1993 | Masuda | H01R 13/631 439/140 |
| 5,775,932 | A * | 7/1998 | Saito | H01R 13/629 439/358 |
| 6,077,117 | A * | 6/2000 | Iwahori | H01R 13/4365 439/595 |
| 6,106,340 | A * | 8/2000 | Myer | H01R 13/4367 439/595 |
| 6,419,515 | B1 * | 7/2002 | Okayasu | H01R 13/627 439/352 |
| 6,589,079 | B2 * | 7/2003 | Kashiyama | H01R 13/422 439/595 |
| 6,902,420 | B2 * | 6/2005 | Muro | H01R 13/6272 439/358 |
| 6,902,432 | B2 * | 6/2005 | Morikawa | H01R 13/6275 439/607.41 |
| 7,563,134 | B2 * | 7/2009 | Kim, Il | H01R 9/20 439/567 |
| 7,988,502 | B2 * | 8/2011 | Nagano | H01R 13/424 439/595 |

(Continued)

FOREIGN PATENT DOCUMENTS

JP 2010-073357 4/2010

*Primary Examiner* — Thanh Tam T Le

(74) *Attorney, Agent, or Firm* — Gerald E. Hespos; Michael J. Porco; Matthew T. Hespos

(57) ABSTRACT

A connector (10) includes a housing (12) to which a mating housing (82) is to be connected from front, side walls (56) constituting an outer surface of the housing (12) and adjacent to upper and lower surfaces via corners (59), and steps (62) provided from the side walls (56) to the corners (59) and becoming gradually thicker in a vertical direction and a lateral direction toward a front side.

5 Claims, 8 Drawing Sheets

(56) References Cited

U.S. PATENT DOCUMENTS

| | | | | |
|---|---|---|---|---|
| 8,408,950 | B2 * | 4/2013 | Jeon | H01R 13/4365<br>439/752 |
| 8,870,586 | B2 * | 10/2014 | Wang | H01R 13/6335<br>439/358 |
| 8,974,243 | B2 * | 3/2015 | Friese | H01R 13/4367<br>439/374 |

* cited by examiner

CONNECTOR

BACKGROUND

Field of the Invention

The invention relates to a connector.

Related Art

Japanese Unexamined Patent Publication No. 2010-73357 discloses a connector with a housing having a tubular receptacle. A mating connector is fit into the receptacle. The receptacle includes a lattice-like thick portion and thin portions surrounded by the thick portion on an outer surface.

The thin portions in the receptacle of the above-described conventional connector reduce the weight of the connector. Thus, this known connector may be less affected by vibration and may suppress fretting wear of terminal fittings accommodated in the housing. However, the thin portions have no substantial function. Also, there is a concern about increased structural waste, and the thin portions are not preferable in terms of appearance.

The invention was completed on the basis of the above situation and aims to provide a connector having high vibration resistance and high added value.

SUMMARY

The invention is directed to a connector with a housing configured so that a mating housing can be connected to the housing from the front. The housing has opposed upper and lower walls and opposed side walls connected to the upper and lower walls at corners. Steps extend from the side walls to the corners. The steps become gradually thicker in a vertical direction and a lateral direction toward a front end.

The steps become gradually thicker in the vertical and lateral directions toward the front end. Thus, a center of gravity of the housing can be located toward a front end, which is a side to be connected to the mating housing. Additionally, a weight of a rear part of the housing can be reduced so that the connector has excellent vibration resistance. Further, fingers easily can catch the steps when connecting the housing to the mating housing, and the steps can be utilized as operating portions at the time of connection. As a result, the steps are functionally effective and add value to the connector.

The housing may include a lightening portion open in a rear surface. The side wall and the corners may constitute an arch defining the lightening portion. The lightening portion reduces a weight of the housing to provide even better vibration resistance. Further, the steps reinforce the arch to enhance the strength of the housing.

The side wall may include a recess constricted into a concave surface between the upper and lower steps to reduce the weight of the housing. Further, fingers easily can be fit to the recess to obtain a satisfactory hold feeling when utilizing the steps as the operating portions at the time of connection.

The recess may be continuous at a constant height in a front-rear direction on the side wall. According to this configuration, the recess and the step can be formed easily.

The housing may include a lock arm for holding the mating housing in a connected state and protection walls may be located on both sides of the lock arm. The lock arm and the protection walls may be provided on either one of the upper or lower surfaces, and the steps may be coupled integrally to the protection walls or arranged near the protection walls. According to this configuration, fingers can be placed on both the protection walls and the steps when utilizing the steps as the operating portions at the time of connection. As a result, suitable application to small-size connectors is possible.

DETAILED DESCRIPTION

Figure 1:
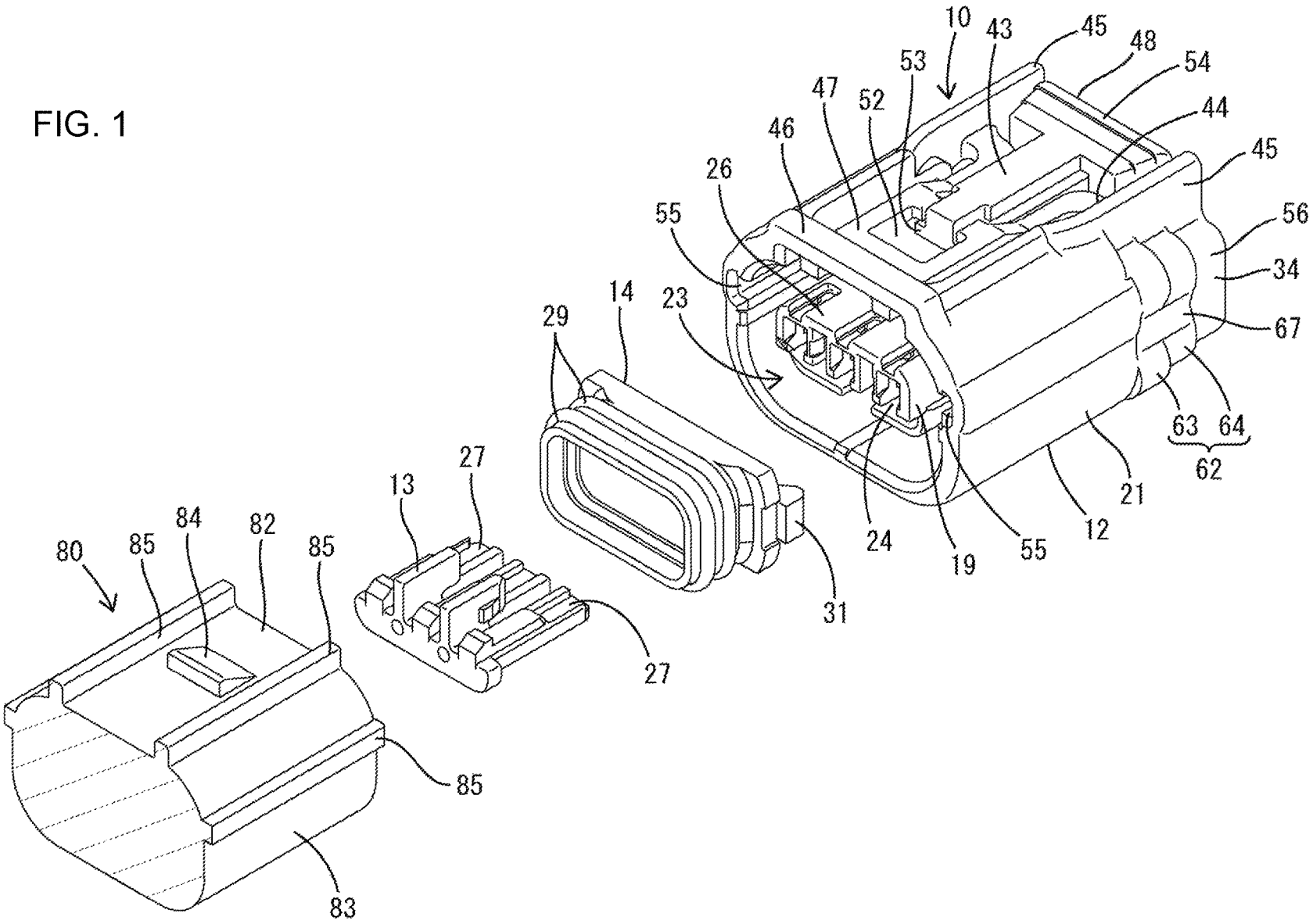
FIG. 1 is an exploded perspective view of a connector according to one embodiment of the invention.

An embodiment of the invention is described with reference to FIGS. 1 to 8. A connector 10 according to this embodiment includes female terminal fittings 11, a housing 12, a retainer 13 and a seal 14. The connector 10 is connectable to a mating connector 80. Note that, in the following description, ends of the connectors 10, 80 facing each other at the start of connection are referred to as front ends concerning a front-rear direction.

Figure 8:
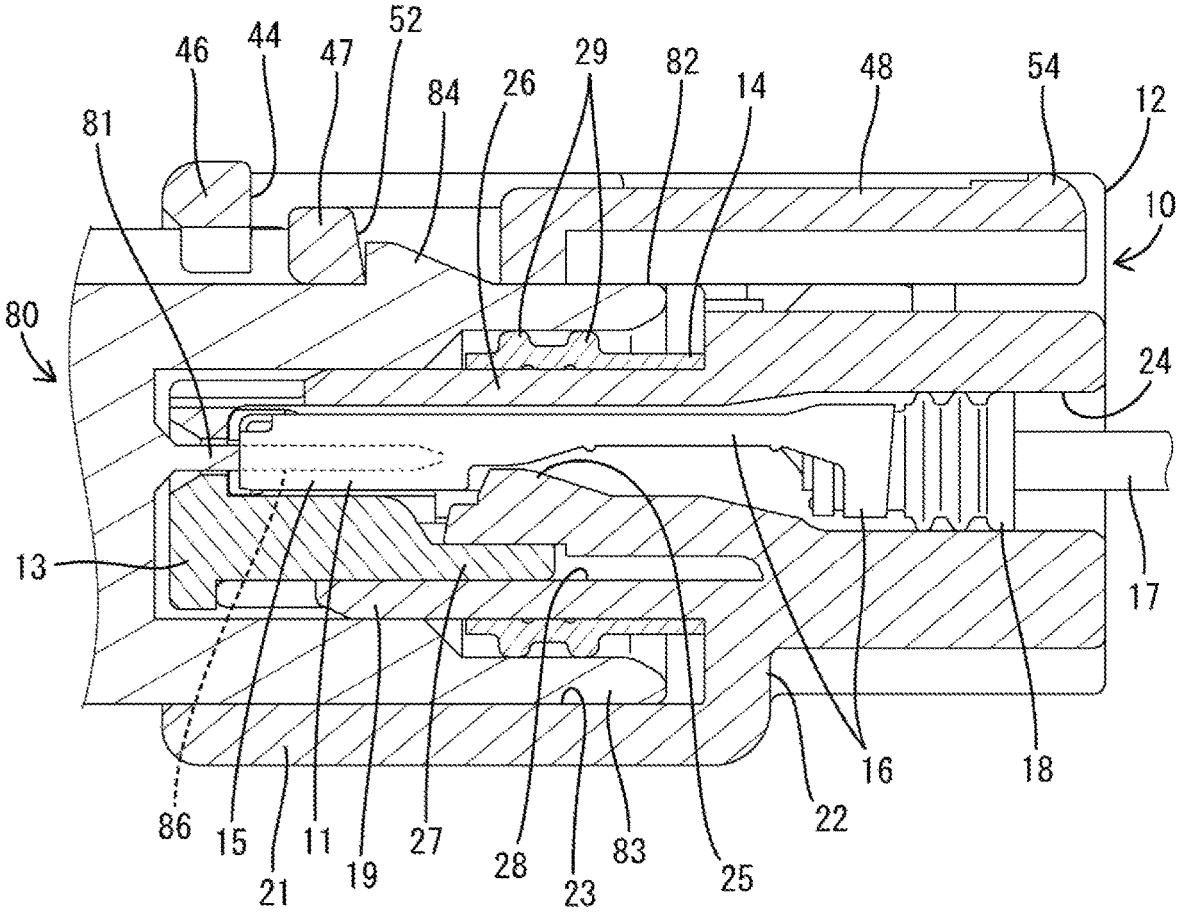
FIG. 8 is a section of the connector properly connected to a mating connector.

The mating connector 80 is mounted directly on a device such as an engine of an unillustrated automotive vehicle. As shown in FIG. 8, the mating connector 80 includes male terminal fittings 81 and a mating housing 82. The mating housing 82 is made of synthetic resin and includes a tubular receptacle 83 projecting forward. As shown in FIG. 1, the receptacle 83 includes a claw-like lock projection 84 in a widthwise central part of an upper surface. Further, ribs 85 extend in the front-rear direction on both left and right sides of the upper surface and on upper parts of left and right side surfaces of the receptacle 83.

The male terminal fitting 81 is made of conductive metal and includes a pin-like tab 86 extending in the front-rear direction, as shown in FIG. 8. The tabs 86 of the respective male terminal fittings 81 are arranged laterally to project in a row in the receptacle 83.

The female terminal fitting 11 is made of conductive metal and, as shown in FIG. 8, is long and narrow in the front-rear direction. The female terminal fitting 11 includes a tubular connecting portion 15 on a front part and an open barrel 16 on a rear part. The connecting portion 15 can receive the tab 86 of the male terminal fitting 81 and is connected electrically to the tab 86 inside when the connectors 10, 80 are connected. The barrel 16 is connected electrically and mechanically to an end part of a wire 17. Further, the barrel 16 is crimped and connected to an individual rubber plug 18 externally fit on the wire 17.

Figure 6:
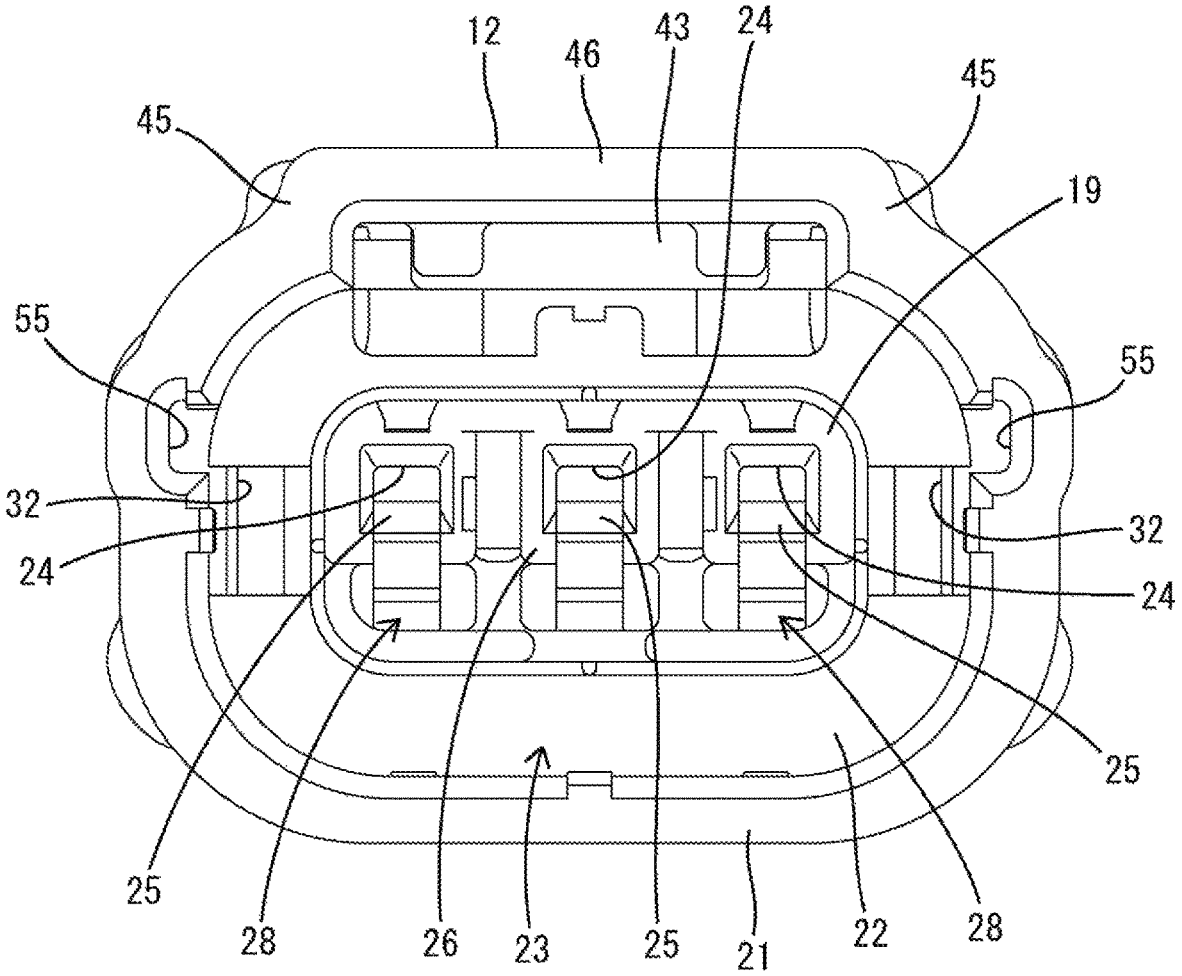
FIG. 6 is a front view of the housing.

The housing 12 is made of synthetic resin and includes a housing body 19 for accommodating the female terminal fittings 11, a fitting tube 21 surrounding the outer periphery of the housing body 19 and a radially extending coupling 22 that couples the fitting tube 21 and the housing body 19. As shown in FIGS. 1 and 6, a space in front of the coupling 22 between the fitting tube 21 and the housing body 19 serves as a connection space 23 into which the receptacle 83 of the mating housing 82 is to be fit.

The housing body 19 includes cavities 24 into which the female terminal fittings 11 are insertable. The respective cavities 24 are provided laterally in a row to correspond to the tabs 86 of the respective male terminal fittings 81. As shown in FIG. 8, each cavity 24 of the housing body 19 includes a cantilevered locking lance 25 projecting forward at the lower surface of an inner wall. The locking lance 25 has a function of primarily retaining the female terminal fitting 11 in the cavity 24 by being resiliently locked to the connecting portion 15 of the female terminal fitting 11.

A part of the housing body 19 located on a front end across the coupling 22 is configured as a retainer mounting portion 26 in which each locking lance 25 is exposed and into which the retainer 13 is mounted to cover each locking lance 25.

The retainer 13 is made of synthetic resin and has retaining portions 27 at positions corresponding to the cavities 24. The retainer 13 restricts deflection of the locking lances 25 and, hence, secondarily retains the female terminal fittings 11 by being mounted into the retainer mounting portion 26 from the front and having the respective retaining portions 27 inserted into deflection spaces 28 for the locking lances 25 as shown in FIG. 8.

The seal 14 is made of rubber, such as silicon rubber, and, as shown in FIG. 1, is annular with lips 29 on an outer periphery and two of mounting pieces 31 (only one is shown in FIG. 1) projecting rearward on both left and right sides.

The seal 14 is fit externally on the housing body 19 from the front and is arranged in front of the coupling 22. The respective mounting pieces 31 are inserted into mounting holes 32 (see FIGS. 6 and 7) in the form of vertically long slits penetrating on both left and right sides of the coupling 22 so that the seal 14 is mounted and retained in the housing 12.

The seal 14 is sandwiched resiliently between the housing body 19 and the receptacle 83 when the receptacle 83 of the mating housing 82 is fit into the connection space 23 of the housing 12 while connecting the connectors 10, 80, as shown in FIG. 8. Each lip 29 of the seal 14 is held resiliently in close contact with the inner surface of the receptacle 83, thereby sealing between the housing 12 and the mating housing 82 in a liquid-tight manner.

Figure 2:
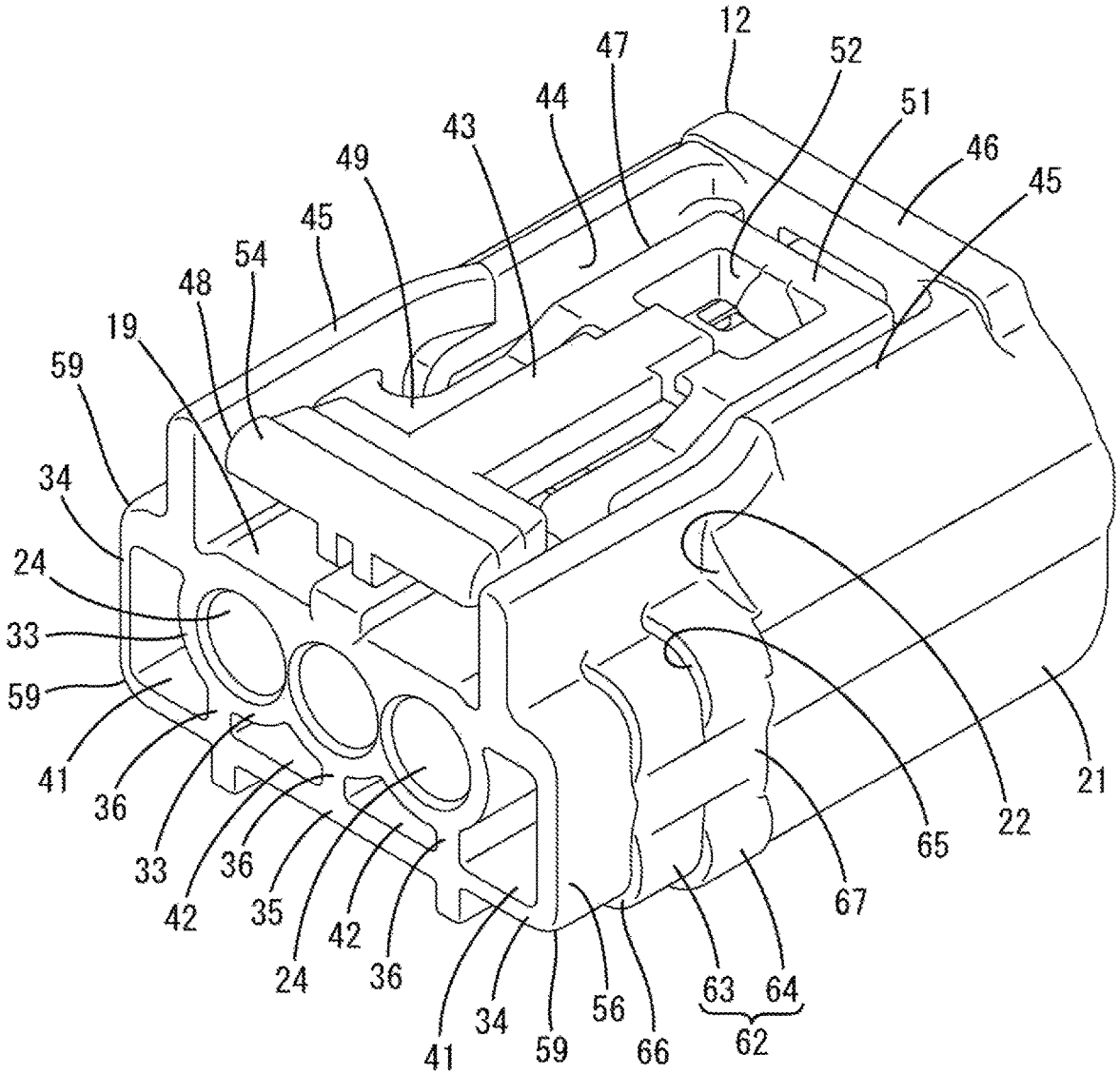
FIG. 2 is a perspective view of a housing viewed from behind.
Figure 7:
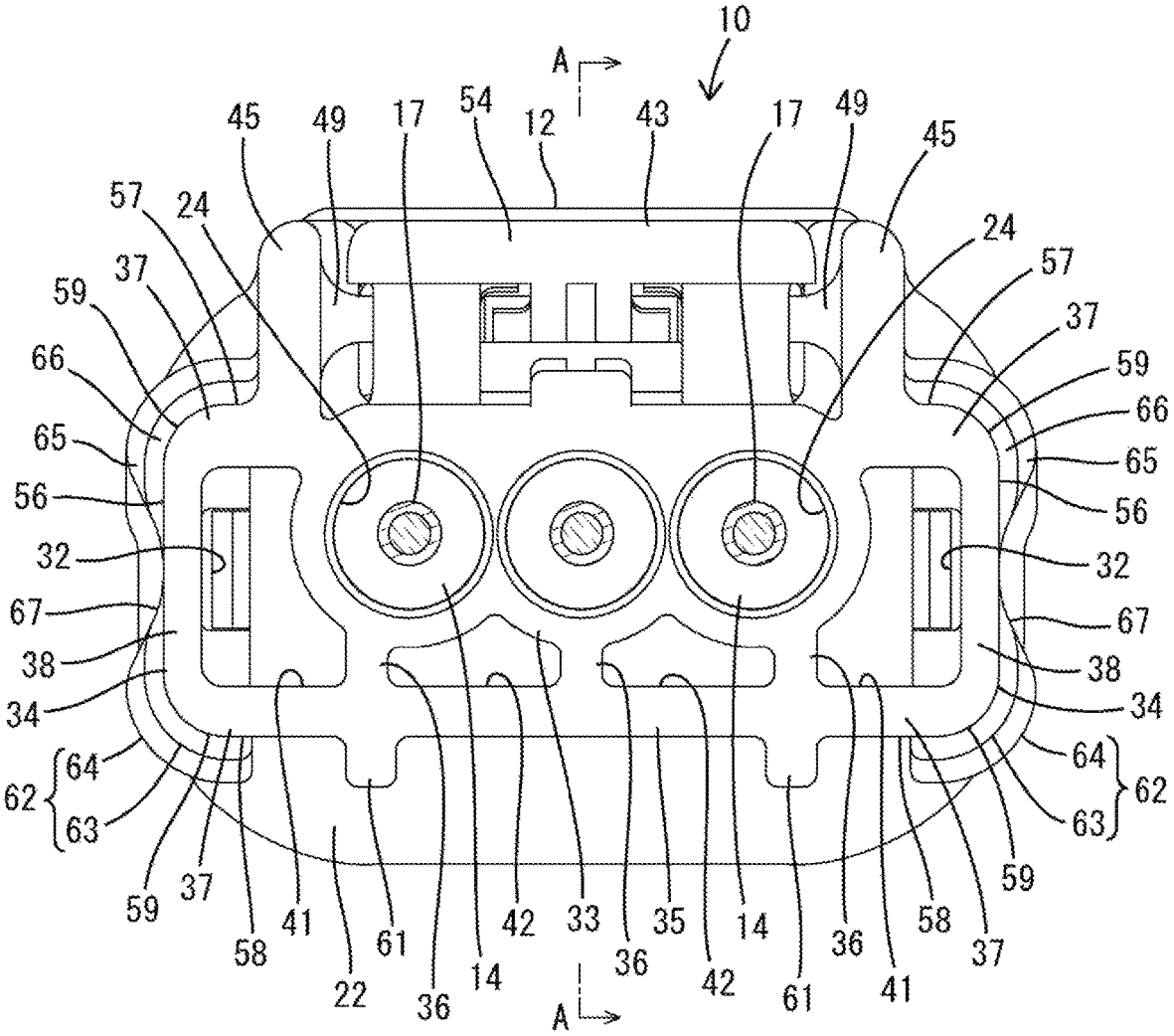
FIG. 7 is a back view of the connector.

As shown in FIGS. 2 and 7, a rear part of the housing body 19 across the coupling 22 includes a cavity tower 33 defining the cavities 24 and having a shape composed of cylinders laterally linked in a row. Two arches 34 cover the cavity tower 33 from left and right sides, and a bottom portion 35 covers the cavity tower 33 from below. Front ends of the arches 34 and the bottom portion 35 are coupled integrally to the coupling 22 in a stepped manner.

Cavity parts of the cavity tower 33 and the bottom portion 35 are coupled integrally by links 36 extending along a height direction.

As shown in FIG. 7, each arch 34 includes upper and lower supports 37 laterally projecting from an upper part of the cavity tower 33 and the bottom portion 35, and a bridge 38 extending substantially in a vertical direction and having upper and lower ends connected to the supports 37. Spaces defined by the arches 34, the links 36, the cavity tower 33 and the bottom portion 35 define lightening portions 41, 42 and are open at the rear of the housing body 19. Back surfaces of the lightening portions 41, 42 are closed by the coupling 22.

As shown in FIG. 7, the lateral lightening portions 41 surrounded by the arches 34, the cavity tower 33 and the links 36 are larger in the vertical direction and have a larger opening area than the bottom lightening portions 42 surrounded by the bottom portion 35, the cavity tower 33 and the links 36. The mounting holes 32 of the coupling 22 and the mounting pieces 31 locked to the mounting holes 32 can be seen through the lateral lightening portions 41 from behind.

Figure 3:
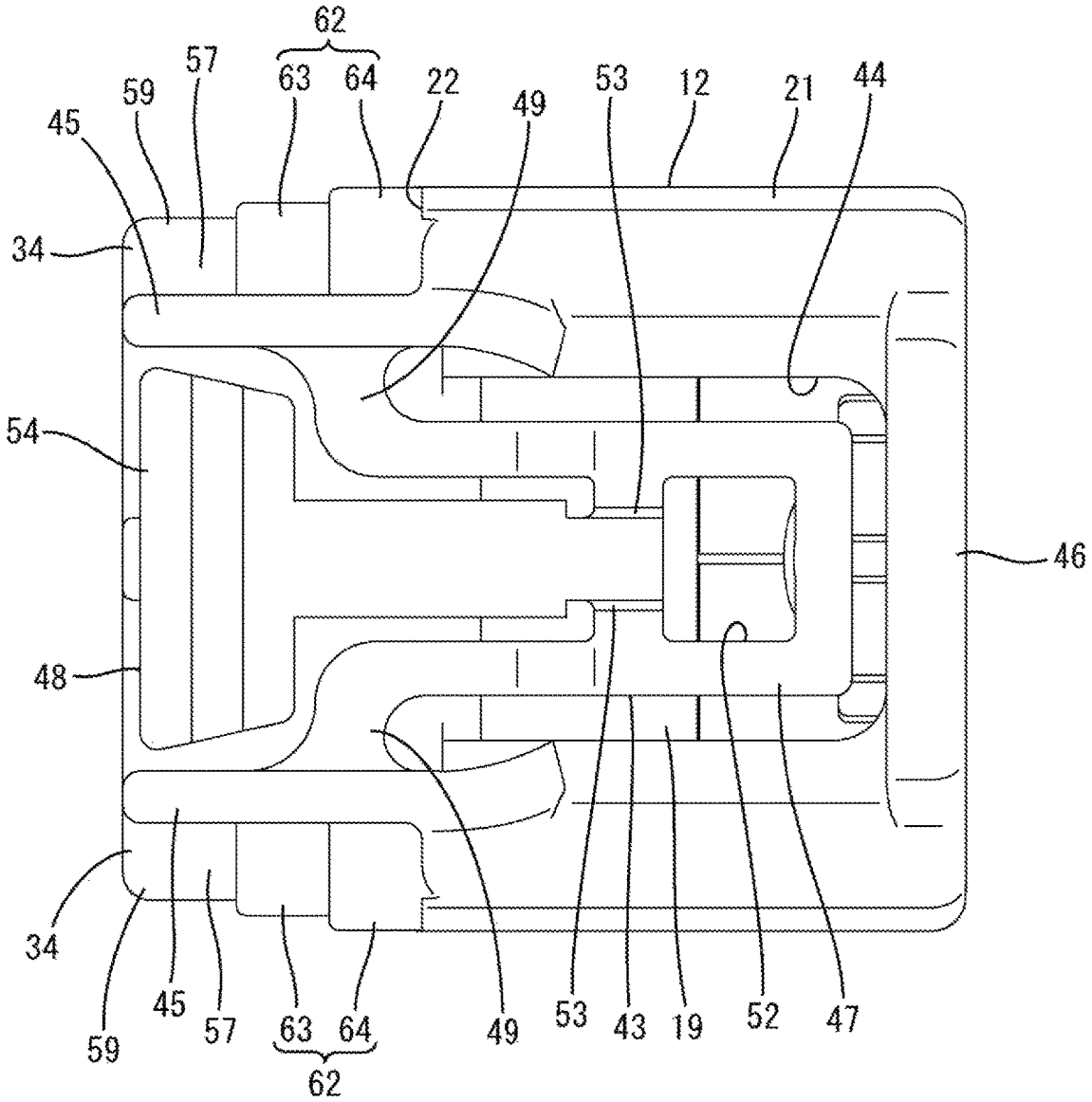
FIG. 3 is a plan view of the housing.

As shown in FIGS. 1 to 3, a lock arm 43 is above the housing body 19. The lock arm 43 can be seen and operated from above through an opening 44 in an upper wall of the fitting tube 21. The opening 44 is between two protection walls 45 rising from both left and right sides of the fitting tube 21 and a horizontal portion 46 extending between the upper ends of front parts of the protection walls 45, and is open rearward. The protection walls 45 are provided over substantially the entire length of the housing 12 in the front-rear direction and form vertical plates rising on a rear of the housing 12, as shown in FIG. 7.

As shown in FIGS. 2 and 3, the lock arm 43 is composed of a lock body 47 on a front end and an unlocking portion 48 on a rear end. The lock body 47 and the unlocking portion 48 are separated from each other. The lock body 47 includes supports 49 connected to the inner surfaces of the protection walls 45, a rectangular frame 51 projecting forward from the supports 49, and a lock hole 52 in the frame 51. The unlocking portion 48 projects both forward and rearward after rising from the upper surface of the housing body 19 and includes, as shown in FIGS. 1 and 3, engaging portions 53 protruding to left and right on a front part and a laterally wide pressing portion 54 on a rear part.

The lock body 47 deflects about the supports 49 when connecting the connectors 10, 80 but then returns resiliently so that the lock projection 84 fits into the lock hole 52 to hold the housings 12, 82 connected (see FIG. 8). On the other hand, the pressing portion 54 is pushed down to separate the connectors 10, 80. Thus, the unlocking portion 48 is displaced resiliently in a seesaw manner and the engaging portions 53 push up the lock body 47. In this way, the lock projection 84 is separated from the lock hole 52 and the housings 12, 82 can be pulled apart.

As shown in FIG. 6, the fitting tube 21 includes two recessed grooves 55 extending in the front-rear direction and open in a front end on the inner surfaces of upper sides of left and right side walls. At the time of connecting the connectors 10, 80, the ribs 85 on the left and right sides of the mating housing 82 are fit into the respective recessed grooves and the ribs 85 on the upper side are inserted into a facing space between the protection walls 45.

As shown in FIG. 7, the outer surface of each arch 34 is composed of a substantially vertical side surface 56 constituting the outer surface of the bridge 38, laterally extending upper and lower surfaces 57, 58 constituting outer surfaces of the upper and lower supports 37, and corners 59 located between the upper and lower surfaces 57, 58 and the side surface 56 and curved to connect the respective surfaces 56, 57 and 58. The upper surface 57 is coupled integrally to the protection wall 45 and the lower surface portion 58 is connected to a lower surface side of the bottom portion 35 via a rib 61. The rib 61 projects in the vertical direction continuously with the link 36.

As shown in FIGS. 1 to 5 and 7, a step 62 thicker on a front than on a rear is provided on the outer surface of each arch 34. The step 62 is provided from the side surface 56 to the corners 59 and further from the corners 59 to the upper and lower surfaces 57, 58.

The step 62 becomes gradually thicker stepwise toward the front and includes a first step portion 63 located on a rear side and a second step portion 64 located on a front and thicker than the first step portion 63. Projecting amounts of the second step portion 64 in the lateral and vertical directions are both larger than those of the first step portion 63. The rear surface of the second step portion 64 is formed into a second step surface 65 substantially perpendicular to the outer surface of the first step portion 63 and extending substantially along the vertical direction, and the rear surface of the first step portion 63 is formed into a first step surface 66 substantially perpendicular to the outer surface of the rear side of the arch 34 and extending substantially vertically. The second step portion 64 is coupled integrally to the rear surface of the coupling 22.

Figure 4:
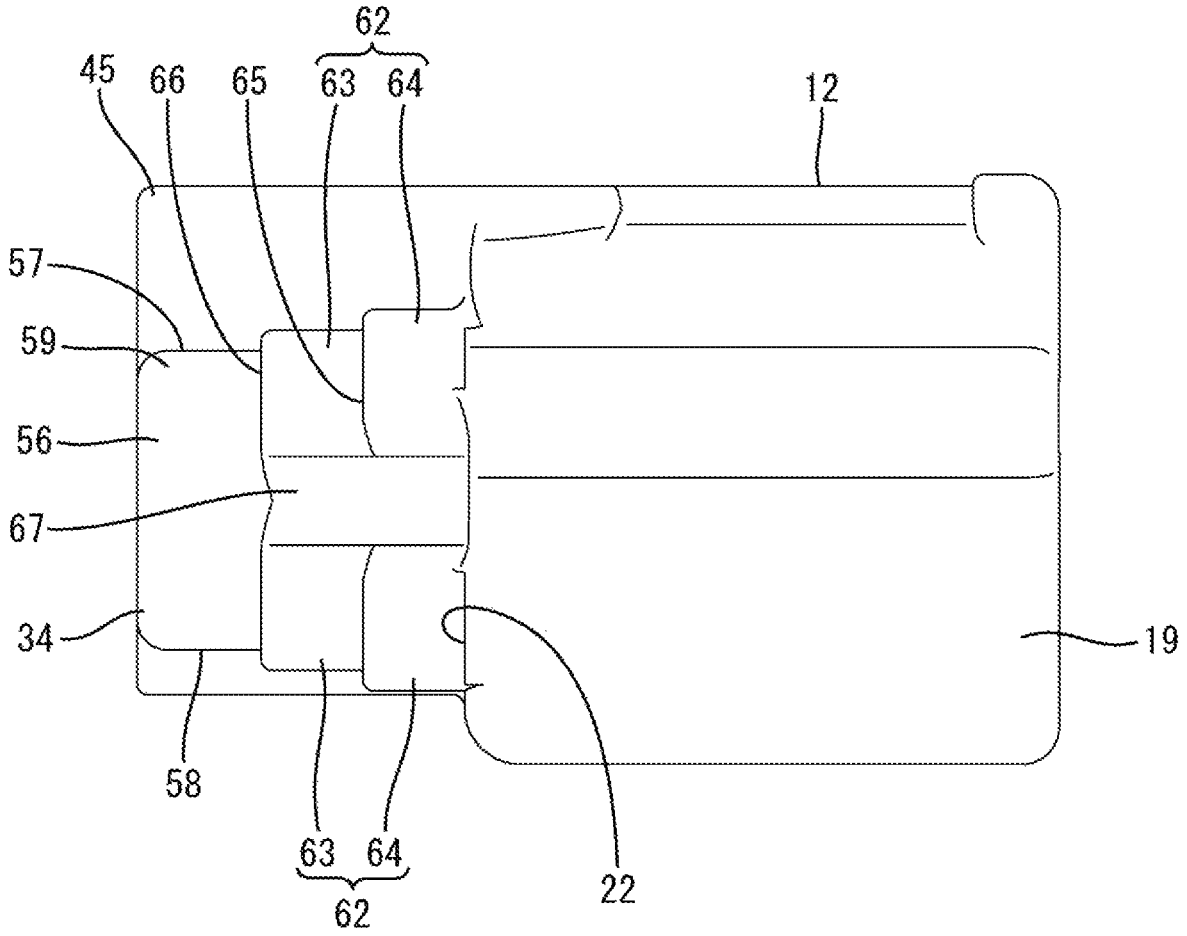
FIG. 4 is a side view of the housing.
Figure 5:
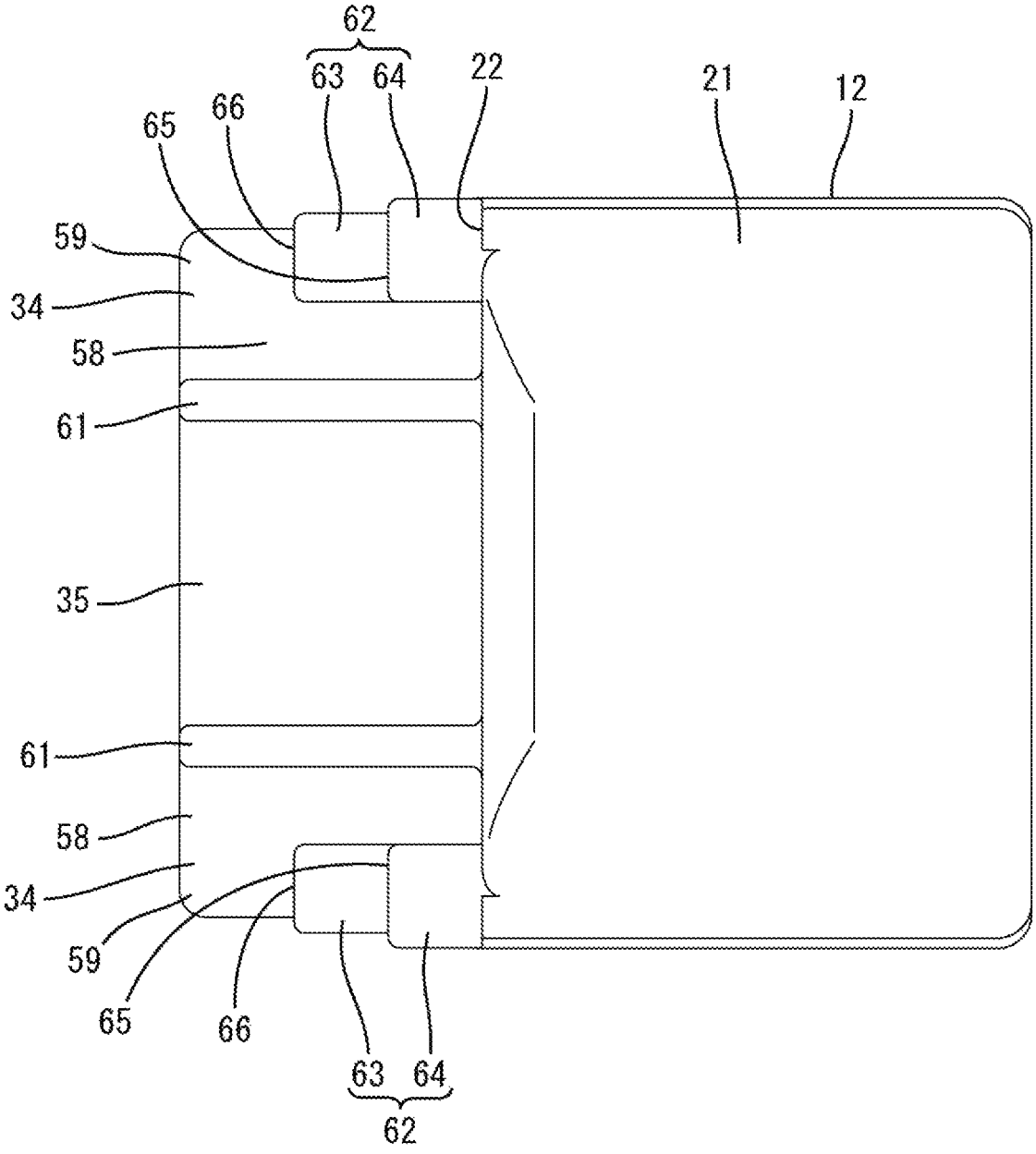
FIG. 5 is a bottom view of the housing.

The step 62 is provided over substantially the entire vertical height of the side surface 56. As shown in FIGS. 4 and 7, each side surface 56 has a recess 67 constricted into a concave surface recessed laterally in from areas on upper and lower ends of the step 62 (areas on the side of the corners 59) to a vertically central area. The recess 67 is continuous over substantially the entire length of the step 62 in the front-rear direction while having the same height (same vertical dimension) and the same depth (same recessed amount). Thus, in the recess 67, the second step surface 65 disappears and the first and second step portions 63, 64 are continuous without any step. As shown in FIG. 7, the entire outer surface of the step 62 is a curved surface (substantially arcuate surface) continuous in a circumferential direction on both upper and lower sides of the arch 34 via the recess 67.

Next, functions and effects of the connector 10 according to this embodiment are described.

Female terminal fittings 11 are inserted into each cavity 24 of the housing body 19 from behind. Each female terminal fitting 11 is held in the corresponding cavity 24 by the locking action of the locking lance 25 and the retainer 13. The wire 17 connected to each female terminal fitting 11 is pulled out rearward from the cavity tower 33 of the housing 12.

Subsequently, the connector 10 is connected to the mating connector 80. At this time, a worker can push the connector 10 into the mating connector 80 while placing fingers on the steps 62 of the housing 12. Specifically, the worker can perform a connecting operation by placing the thumb and index finger on the respective left and right steps 62 of the housing 12 and sandwiching the housing 12 from left and right sides. At this time, the first and second step surfaces 66, 65 catch the respective fingers and function as slip stoppers. Further, each finger pulp part is fit to the concave surface (curved surface) of the recess 67, so that a pressing force of each finger is transmitted directly to the housing 12 without waste. Further, by placing parts of fingertips on the protection walls 45 continuous with the steps 62, the side surfaces of the protection walls 45 can be utilized as operation areas.

When the receptacle 83 of the mating housing 82 is fit to a proper depth into the connection space 23 of the housing 12, the lock arm 43 resiliently locks the lock projection 84 and the connectors 10, 80 are held connected (see FIG. 8). The worker can detect that the connectors 10, 80 are connected properly by obtaining a tactile feeling (lock feeling) due to the resilient return of the lock arm 43.

If a device directly connected to the mating connector 80 vibrates after the connection of the connectors 10, 80, such a vibration force is transmitted to the connector 10 via the mating connector 80. This may generate a large inertial force on each wire 17 pulled out from the rear of the housing 12 and the female and male terminal fittings 11, 81 accommodated in the housings 12, 82 may slide against each other and wear. Thus, it is desired to make the rear side of the housing 12 as light as possible. In that respect, since the steps 62 become gradually thicker toward the front in this embodiment, a weight of the rear side of the housing 12 is small and a center of gravity of the housing 12 is more forward. As a result, vibration resistance of the connector 10 can be improved.

Further, the lightening portions 41, 42 are in the rear of the housing 12 and make the rear of the housing 12 lighter to improve vibration resistance even further. In addition, the lateral lightening portions 41 are defined by the arches 34 and the steps 62 are padded on the side surfaces 56 and the corners 59 constituting the outer surfaces of the arches 34. Thus, the lightening portions 41, 42 do not reduce the strength of the housing 12.

The recesses 67 between the upper and lower areas of the steps 62 provide a satisfactory hold feeling for the fingers. Further, the recesses 67 are continuous at a constant height in the front-rear direction so that the recesses 67 and the steps 62 are formed easily.

The worker also can place fingers also on the protection walls 45 in addition to the steps 62. As a result, suitable application to the smalls-size connector 10 is possible.

Other embodiments are described briefly below.

The steps may not be provided in vertically central parts of the side surfaces of the housing.

The steps may not be provided on the upper and lower surfaces of the housing.

The steps may be arranged in proximity to the protection walls without being integrally coupled to the protection walls.

The step may become gradually thicker by having three or more steps.

The lock arm and the protection walls may be provided on the lower surface of the housing.

The connector may be a male connector including a receptacle, tabs of male terminal fittings projecting in the receptacle.

LIST OF REFERENCE SIGNS

10 . . . connector
12 . . . housing
34 . . . arch
41 . . . lightening portion (lateral lightening portion)
42 . . . lightening portion (bottom lightening portion)
45 . . . protection wall
56 . . . side wall
59 . . . corner
62 . . . step
67 . . . recess
80 . . . mating connector
82 . . . mating housing

What is claimed is:

1. A connector, comprising:

a housing having opposite front and rear ends, the front end being configured to be connected to a mating housing;

the housing having opposite upper and lower surfaces and opposite side walls constituting an outer surface of the housing, the side walls being joined to the upper and lower surfaces via upper and lower corners respectively; and upper and lower arched steps provided at plural positions in a front-rear direction so that each of the upper and lower arched steps extends from the respective side wall to the upper and lower corners, the steps including forward-most steps that are smaller in a vertical direction and a lateral direction than each of the steps at more rearward positions, and each of the steps rearward of the forward-most steps being larger in the vertical and lateral directions than the steps at more forward positions.

2. The connector of claim 1, wherein cavities extend through the housing in the front-rear direction for accommodating terminal fittings, and the housing includes lightening portions defining openings extending forward in the rear surface at positions outward of the cavities and inward of the side walls and the corners.

3. The connector of claim 1, wherein each of the side walls includes a recess constricted into a concave surface between the upper and lower steps.

4. The connector of claim 3, wherein each of the recesses is continuous at a constant height in the front-rear direction on the side wall (56).

5. The connector of claim 1, wherein the housing includes a lock arm for holding the mating housing in a connected state and protection walls located on both sides of the lock arm, the lock arm and the protection walls being provided on one of the upper or lower surfaces, and the steps are coupled integrally to the protection walls or arranged in proximity to the protection walls.

* * * * *